United States Patent [19]

Scholz

[11] 3,986,070

[45] Oct. 12, 1976

[54] PICK-UP TUBES

[75] Inventor: Hans Scholz, Maldon, England

[73] Assignee: English Electric Valve Company Limited, Chelmsford, England

[22] Filed: Jan. 6, 1975

[21] Appl. No.: 538,940

Related U.S. Application Data

[63] Continuation of Ser. No. 365,691, May 31, 1973, abandoned.

[30] Foreign Application Priority Data

June 15, 1972 United Kingdom ..... 28000/72

[52] U.S. Cl. ..... 313/384; 313/371; 313/478

[51] Int. Cl.[2] ..... H01J 31/38; H01J 29/89

[58] Field of Search ..... 313/371, 372

[56] References Cited

UNITED STATES PATENTS

| | | | |
|---|---|---|---|
| 2,607,900 | 8/1952 | Schulte | 313/446 X |
| 3,114,068 | 12/1963 | Shortridge | 313/237 |
| 3,601,651 | 8/1971 | Neis | 313/237 |
| 3,628,076 | 12/1971 | Weijland et al. | 313/372 X |

OTHER PUBLICATIONS

Bailey, New Lead-Oxide Tubes; Sound Vision Broadcasting; Great Britain, vol. 11, No. 2, Summer, 1970; pp. 19–21.

*Primary Examiner*—Robert Segal

*Attorney, Agent, or Firm*—Baldwin, Wight & Brown

[57] ABSTRACT

A photo-conductive target pick-up tube has a vacuum sealed envelope housing a tubular anode electrode on the gun cathode side of the target. The anode electrode is roughened on its inner surface to provide light scattering from a lamp which is mounted in a cavity protruding into the envelope but which cavity is sealed from the vacuum inside the envelope. The lamp is mounted on the longitudinal axis of the axis so as to provide an artificial dark current which tends to reduce build-up and decay lag at low light level operating conditions.

13 Claims, 5 Drawing Figures

PICK-UP TUBES

This is a continuation of application Ser. No. 365,691 filed May 31, 1973, now abandoned.

This invention relates to pick-up tubes and more particularly to pick-up tubes of the photo-conductive target type such as those described in our co-pending application Ser. No. 166,119.

The co-pending application Ser. No. 166,119 seeks to provide improved photo-conductive target pick-up tubes of the kind in which the target exhibits a natural relatively low dark current, and in particular improved lead monoxide pick-up tubes, in which the tendency to suffer from build up lag and decay lag is reduced. It is known from this co-pending application to provide a photo-conductive target pick-up tube having the inner surface of the normally provided tubular anode electrode on the gun cathode side of the target roughened or otherwise provided to have light scattering properties in order to achieve diffused illumination of the rear of the target from a light source, so that in operation an artificial dark current is obtained which tends to reduce build up and decay lag at low light level operating conditions.

In one embodiment of our co-pending application Ser. No. 166,119, the light source is external of the tube envelope in which case a plurality of small light bulbs are mounted around the neck of the tube.

In a further and preferred embodiment of our co-pending application the light source is internal of the tube envelope, in which case a light bulb is mounted adjacent the heating of the cathode gun.

The reason for the preference for a light source mounted internally of the tube envelope is the important practical one that the tube outline need not differ from conventional pick-up tubes having no provision for light biassing. Thus a light biassed tube may be produced which is a direct replacement for a conventional tube. However, this practice has the disadvantage that, without destroying the vacuum, the light source cannot be changed whether it be for replacement due to premature failure or, as is sometimes required, to replace it with a light source of different colour.

Where the light source is external of the tube envelope this difficulty is avoided, but this practice has not found favour because the accommodation for the light source changes the outline of the pick-up tube. For example, if the external light source consists of a ring of bulbs mounted in the end cap of the tube, it will be realised that a non-standard end cap is required.

The present invention seeks to provide an improved pick-up tube in which the light source may be changed without destroying the vacuum in the tube envelope, whilst at the same time not necessarily requiring accommodation which changes the normal outline of the tube.

According to this invention a photo-conductive target pick-up tube includes a vacuum sealed envelope and within said envelope a target, a gun cathode spaced from said target, a tubular anode electrode on the gun cathode side of the target, the inner surface of the anode electrode having light scattering properties to provide diffused illumination at the rear of said target said tube further includes a light source, a cavity extending into the interior of said envelope but which is sealed against the vacuum therein and which cavity is shaped so as to accommodate said light source within the overall outline of the pick-up tube such that in operation an artificial dark current is obtained which tends to reduce build up and decay lag at low light level operating conditions.

Preferably the cavity is so arranged as to accommodate said light source substantially on the longitudinal axis of said tube.

Preferably again said cavity is located in such a position that it is covered by the normally provided end cap of the tube.

In a preferred embodiment of the invention the cavity is provided by a tubular housing member which is open at least at one end and which extends diametrically across the normally provided skirt glass on the stem of the tube over which the normally provided end cap is fitted.

In another embodiment of the invention the cavity extends from the base glass of the tube envelope.

Preferably a light source used in said cavity has connection leads therefore extending around the outside of the tube envelope, within said normally provided end cap and connected to the pins extending through the base glass of said tube envelope to which the heater of the cathode gun is connected, so that the light source operates in parallel with said heater.

Where as is preferred the cavity with a light source accommodated therein is covered by the normally provided end cap of the tube replacement of the light source obviously entails removal of the end cap. This is normally secured to the skirt glass of the tube envelope by means of an adhesive. Its removal, however, by means of a suitable solvent, is a relatively simple matter not requiring the facilities of a factory. It is therefore possible to change the light source "in the field".

The invention is illustrated in and further described with reference to the accompanying drawings in which, FIG. 1 is an outline elevation of one television pick-up tube in accordance with the present invention, FIG. 2 is a cross section on the line A—A of FIG. 1

Figure 1:
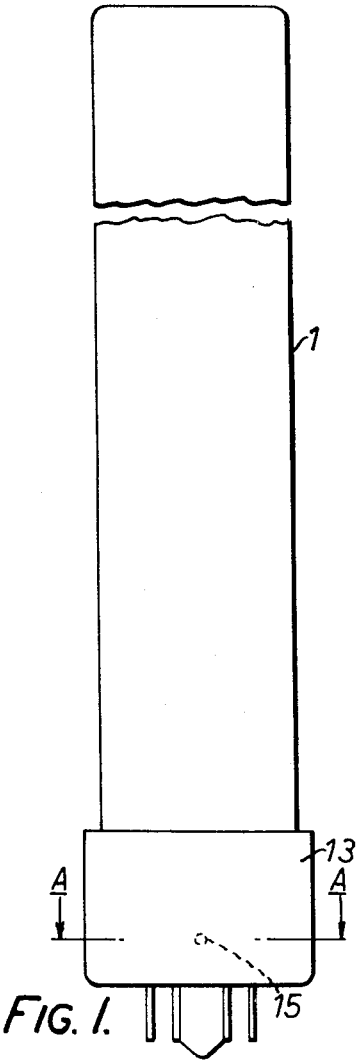
Figure 3:
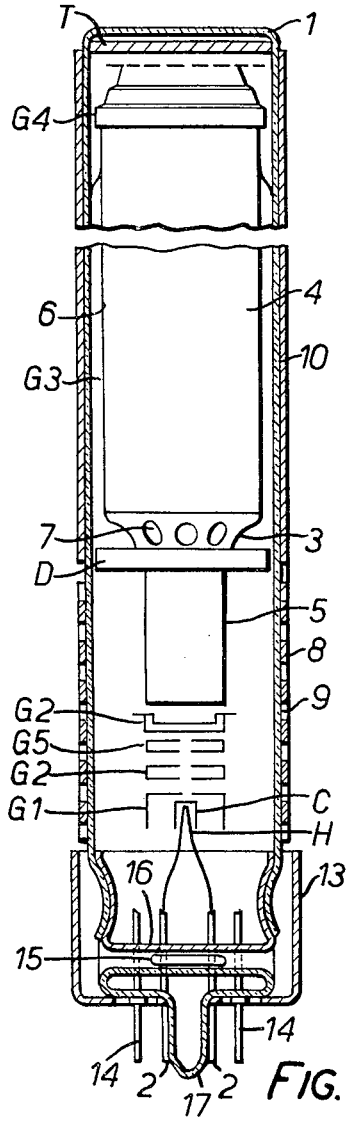
FIG. 3 is a part sectioned orthogonal elevation of the tube shown in FIG. 1
Figure 2:
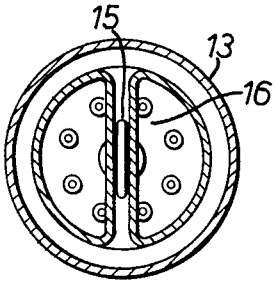
Figure 4:
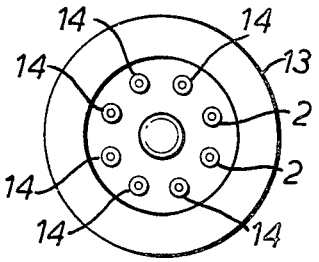
FIG. 4 is a plan view of the pin end of the tube of FIG. 1.

Referring to FIG. 1 to 4 the pick-up tube shown therein consists of a glass envelope 1 having at one end a gun cathode C indirectly heated by a heater H connected through the envelope to supply pins 2 mounted in an end cap 13. The remaining pins are referenced 14. G1, G2 and G4, G5 are the normally provided electrodes known under those designations whilst G3 is the normally provided tubular anode electrode and T is the normally provided lead monoxide target electrode consisting of a layer of lead monoxide deposited on a film of conductive tin oxide on the face plate of the tube. As will be seen the tubular anode electrode G3 has a reducing tapered portion 3 which joins a portion 4 of larger cross-sectional dimension and a portion 5 of smaller cross-sectional dimension. The interior surface 6 of the tubular anode electrode G3 is roughened by chemical etching and a ring of holes 7, 11 in number, are provided in the reducing tapered portion 3 of the tubular anode electrode G3 so as to permit light to enter the inside thereof, which light, scattered by the roughened interior surface 6, provides diffused illumination of the interior surface of the target T. This diffused illumination produces an artificial dark current which tends to reduce build-up and decay lag experienced at low light levels. A ring D of ground fused silica is provided around the portion 5 of the tubular electrode G3, shielding the holes 7.

Bands of black and white paint 8 and 9 respectively are provided on the glass envelope of the tube between the gun cathode section and the fused silica ring D so as to adjust the effective intensity of the illumination of the interior surface of the target T following manufacture (this is not an adjustment usually required during service). In order to reduce the possibility of stray light reaching the front of the target T, the section of the tube envelope between the region of reduction in the cross-sectional dimensions of the tubular anode electrode G3 and the target T is given a coating 10 of black paint.

As so far described the pick-up tube is as described in our co-pending application Ser. No. 166,119.

In accordance with the present invention a light biassing lamp 15 is positioned centrally within a glass tubular member 16, extending diametrically across the skirt glass 17 on the tube stem, sealed against the vacuum in the interior of the tube. The connecting leads for the lamp 15 are taken out of one end of the tubular member 16 around the outside of the tube envelope within the end cap 13 and connected one to pin 2 and the other to the other pin 2 so as to operate in parallel with the heater for the cathode gun.

Figure 5:
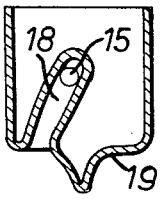
FIG. 5 shows in section the base end of another tube in accordance with the present invention.

Referring to FIG. 5, in this case a cavity 18 extends from a glass base 19 of the tube in such a manner as to enable the lamp 15 again to the accommodated on the longitudinal axis of the tube.

A tube in accordance with this invention has important practical advantages over any of the tubes shown in the drawings of our co-pending application Ser. No. 166,119. In the first place, since the lamp is no longer in the evacuated space of the tube envelope, it is a relatively simple matter to replace it in the event of premature failure, for all that is necessary to do to render it accessible is to remove the end cap and adhesive material by means of which it is held onto the end of the tube proper using a suitable solvent so that the end or ends of cavity are open to allow the failed lamp to be withdrawn and a new one substituted. For the same reason it is relatively easy to change the colour of the light — i.e. to fit a lamp of a different colour or one having a light filter — should it be necessary to do so in order to optimise the bias shading. Finally, because of the way in which the lamp is accommodated within the overall outline of the tube a tube in accordance with this invention may have the same external dimensions and shape as an otherwise similar known tube. This last advantage is of considerable practical importance since it enables tubes in accordance with this invention to be made as direct replacement tubes in existing cameras.

I claim:

1. In a photo-conductive target pick-up tube having an elongate, evacuated glass envelope presenting a face plate at one end of the tube and a stem at the opposite end of the tube; a target electrode deposited on the inner surface of said face plate which exhibits a natural relatively low dark current; a gun cathode disposed centrally of said tube adjacent the stem end thereof; a tubular anode electrode between said gun cathode and said target electrode and including a portion of smaller cross section extending from adjacent said gun cathode toward said target electrode and a portion of larger cross section extending from adjacent said portion of smaller cross section to said target electrode, said portion of larger cross section having an internal surface of light scattering property to provide diffused illumination of said target, and means for admitting light into the interior of said portion of larger cross section at that end thereof adjacent the portion of smaller cross section whereby to provide artificial dark current at said target; reflective coating means on the external surface of said stem end of said glass envelope between said gun cathode and said means for admitting light; and an end cap adhesively secured to said glass envelope in surrounding relation to a portion of said stem, there being supply pins projecting through said glass envelope and said end cap whereby the tube may be employed as a direct replacement for tubes of prescribed external dimensions and shape; the improvement in which:

said stem of the glass envelope is provided with a recess between said gun cathode and said opposite end of the tube, said recess reaching substantially the longitudinal axis of said glass envelope and having a region extending along a line transverse to such axis; and a removable light biassing lamp disposed within said region of the recess whereby to illuminate the interior of said stem end of the glass envelope without violating said prescribed external dimensions and shape.

2. In a photo-conductive target pick-up tube as defined in claim 1 wherein said recess extends transversely through said stem of the glass envelope in a region thereof surrounded by said end cap, whereby said light biassing lamp may be replaced by removal of said end cap, removal and replacement of said lamp, and replacement of said end cap.

3. In a photo-conductive target pick-up tube as defined in claim 2 wherein supply pins for said lamp extend through said end cap, through said glass envelope into the evacuated interior of said tube, and again through said glass envelope into said recess.

4. In a photo-conductive target pick-up tube as defined in claim 1 wherein supply pins for said lamp extend through said end cap, through said glass envelope into the evacuated interior of said tube, and again through said glass envelope into said recess.

5. A photo-conductive target pick-up tube including a vacuum sealed envelope and within said envelope a target, a gun cathode spaced from said target and a tubular anode electrode on the gun cathode side of the target, the inner surface of the anode electrode having light scattering properties and said tube further including a light source positioned within the overall outline of said envelope to provide an illumination emanating from within said overall outline, and means responsive to said illumination for directing light into the interior of said anode electrode onto said inner surface thereof to provide diffused illumination at the rear of said target such that in operation an artificial dark current is obtained which tends to reduce build-up and decay lag at low light level operating conditions, and wherein there is provided a cavity shaped to accommodate said light source and extending into the interior of said envelope but which is sealed against the vacuum therein, said light source being disposed in said cavity within said overall outline of the pick-up tube so as to be accessible for the purpose of replacement from outside said overall outline.

6. A tube as claimed in claim 5 and wherein the cavity extends inwardly substantially to the longitudinal axis of said tube.

7. A tube as claimed in claim 5 and wherein said cavity extends inwardly from a portion of the envelope covered by the normally provided end cap of the tube.

8. A tube as claimed in claim 5 wherein the cavity is provided by a tubular housing member which is open at least at one end and which extends diametrically across the normally provided skirt glass on the stem of the tube over which the normally provided end cap is fitted.

9. A tube as claimed in claim 7 wherein the cavity extends from the base glass of the tube envelope.

10. A tube as claimed in claim 5 wherein a light source used in said cavity has connection leads therefor extending around the outside of the tube envelope, within said normally provided end cap and connected to the pins extending through the base glass of said tube envelope to which the heater of the cathode gun is connected, so that the light source operates in parallel with said heater.

11. In a photo-conductive target pick-up tube having an elongate, evacuated glass envelope presenting a face plate at one end of the tube and a stem at the opposite end of the tube; a target electrode on the inner surface of said face plate and which exhibits a natural relatively low dark current; a gun cathode adjacent the stem end of the tube; a tubular anode electrode between said gun cathode and said target electrode and aligned therebetween, said anode electrode having an internal surface of light scattering property to provide diffused illumination of said target, and means for admitting light into the interior of said anode electrode whereby to provide artificial dark current at said target; and supply pins projecting through the stem of said glass envelope whereby the tube may be employed as a direct replacement for tubes of prescribed external dimensions and shape; the improvement in which:

said stem of the glass envelope is provided with a recess between said gun cathode and said opposite end of the tube, said recess reaching substantially the longitudinal axis of said glass envelope and having a region extending along a line transverse to such axis, said recess being sealed against the vacuum in said evacuated glass envelope; and a removable light biassing lamp disposed within said region of the recess whereby to illuminate the interior of said stem end of the glass envelope without violating said prescribed external dimensions and shape, and so as to be accessible for the purpose of replacement from outside said recess.

12. In a tube as defined in claim 11 including directing means disposed between said light biassing lamp and said means for admitting light for directing light from said lamp to said means for admitting light.

13. In a tube as defined in claim 12 wherein said directing means comprises a reflective coating associated with said glass envelope.

* * * * *